US012453402B2

(12) United States Patent
Schipper et al.

(10) Patent No.: US 12,453,402 B2
(45) Date of Patent: Oct. 28, 2025

(54) DEODORANT DISPENSER

(71) Applicant: WEENER PLASTICS GROUP B.V., Ede (NL)

(72) Inventors: Michael Schipper, Weener (DE); Willem Ramon, Ede (NL); Marcel Pater, Ede (NL)

(73) Assignee: WEENER PLASTICS GROUP B.V., Ede (NL)

( * ) Notice: Subject to any disclaimer, the term of this patent is extended or adjusted under 35 U.S.C. 154(b) by 132 days.

(21) Appl. No.: 18/003,106

(22) PCT Filed: Jun. 26, 2020

(86) PCT No.: PCT/EP2020/068069
§ 371 (c)(1),
(2) Date: Jul. 19, 2023

(87) PCT Pub. No.: WO2021/259496
PCT Pub. Date: Dec. 30, 2021

(65) Prior Publication Data

US 2024/0065416 A1 Feb. 29, 2024

(51) Int. Cl.

| | |
|---|---|
| ***A45D 40/04*** | (2006.01) |
| ***A45D 40/14*** | (2006.01) |
| ***A45D 40/16*** | (2006.01) |
| *A45D 40/00* | (2006.01) |

(52) U.S. Cl.
CPC ..... *A45D 40/04* (2013.01); *A45D 40/14* (2013.01); *A45D 40/16* (2013.01); *A45D 2040/0043* (2013.01)

(58) Field of Classification Search
CPC ..... A45D 40/04; A45D 40/14; A45D 40/16; A45D 2040/0043
See application file for complete search history.

(56) References Cited

U.S. PATENT DOCUMENTS

| | | | | |
|---|---|---|---|---|
| 11,033,091 | B2 * | 6/2021 | Wiesenthal | A45D 40/16 |
| 11,950,681 | B2 * | 4/2024 | Niemeyer | A45D 40/04 |

(Continued)

FOREIGN PATENT DOCUMENTS

| | | |
|---|---|---|
| DE | 4227387 | 2/1994 |
| WO | WO 2010/072668 | 7/2010 |

OTHER PUBLICATIONS

International Search Report and Written Opinion (with English translation) for International (PCT) Patent Application No. PCT/EP2020/068069, dated Mar. 5, 2021 22 pages.

(Continued)

*Primary Examiner* — Jennifer C Chiang
(74) *Attorney, Agent, or Firm* — Sheridan Ross P.C.

(57) ABSTRACT

A deodorant dispenser includes a container and a rotary body with a first coupling. A refill pack filled with a deodorant composition for the deodorant dispenser includes a refill container, a refill spindle, and a refill elevator that is movable up and down on an outer thread of the refill spindle. The refill spindle has a second coupling which, upon insertion of the refill container into the container of the deodorant dispenser, is connectable with form-fit engagement and for conjoint rotation to the first coupling of the rotary body of the deodorant dispenser.

30 Claims, 9 Drawing Sheets

(56) References Cited

U.S. PATENT DOCUMENTS

Figure 1B:
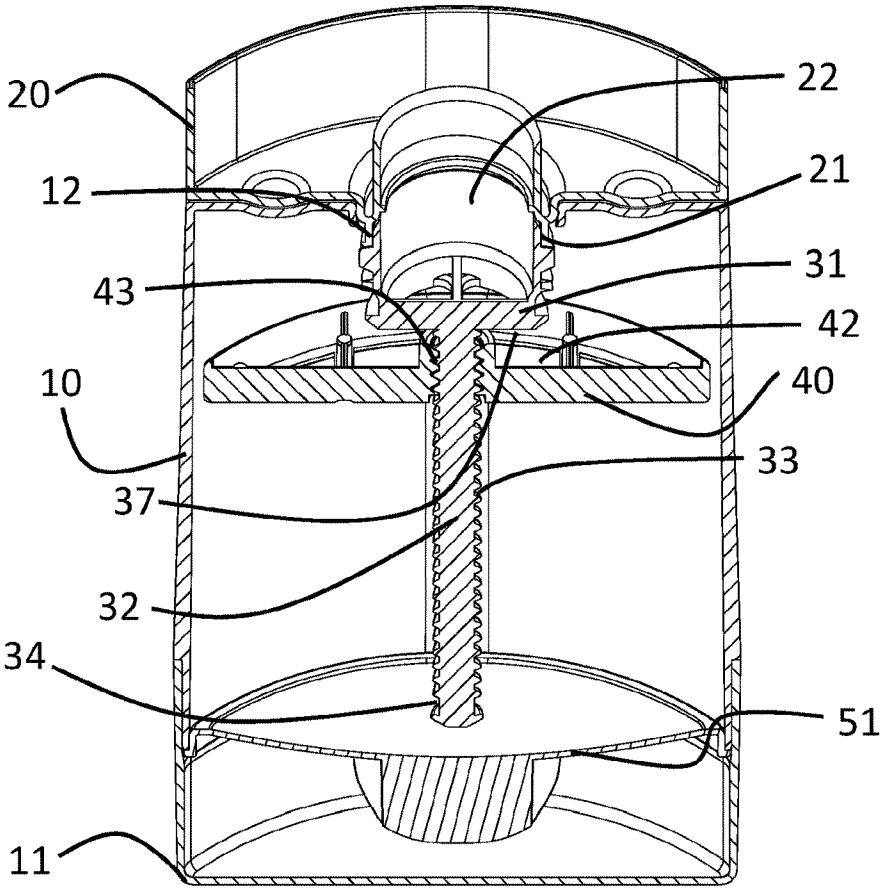

| | | | | |
|---|---|---|---|---|
| 2013/0028649 | A1* | 1/2013 | Kobayashi | A45D 40/04 401/61 |
| 2020/0054110 | A1 | 2/2020 | Wiesenthal et al. | |

OTHER PUBLICATIONS

International Preliminary Report on Patentability (with English translation) for International (PCT) Patent Application No. PCT/EP2020/068069, dated Dec. 13, 2022 7 pages.

* cited by examiner

DEODORANT DISPENSER

CROSS REFERENCE TO RELATED APPLICATIONS

This application is a national stage application under 35 U.S.C. § 371 and claims the benefit of PCT Application No. PCT/EP2020/068069 having an international filing date of 26 Jun. 2020, which designated the United States, the disclosure of which is incorporated herein by reference in its entirety.

The present invention relates to a deodorant dispenser, a refill pack for such a deodorant dispenser, a deodorant dispenser system consisting of at least one such deodorant dispenser and at least one such refill pack, a method for filling such a deodorant dispenser with a deodorant mass as well as a method for refilling such a deodorant dispenser with a refill pack.

The deodorant dispensers at issue here, which are filled with a solid but yielding deodorant mass to be applied to the skin, are also referred to as deodorant sticks.

Due to their mechanical function, the deodorant dispensers currently on the market are complex mechanical systems that usually have between four and eight components. Owing to this large number of different components, companies in the cosmetics industry face greater costs and logistical problems when relaunching a deodorant dispenser. Accordingly, deodorant dispensers are redesigned less frequently than is the case with, for example, packaging consisting only of a container and a closure. Deodorant dispensers thus often stay on the market for ten or more years without any change being made to their geometry.

On the other hand, deodorant dispensers are mostly made of plastic. Plastic packaging currently faces intense public scrutiny from an environmental standpoint. There is thus high demand for the multiple use of deodorant dispensers by way of a refill (so-called "refill options").

US 2020/0054110 A1 describes a deodorant dispensing system which comprises a reusable housing having a body and a rotating knob rotatably connected to the body. The body is structured so as to receive a replaceable deodorant cartridge having a sleeve and a stick of deodorant substance inserted therein.

The present invention is based on the task of providing an improved refillable deodorant dispenser and associated refill pack.

This task is solved by a deodorant dispenser according to claim 1, a refill pack for such a deodorant dispenser according to claim 13, a deodorant dispenser system according to claim 25, a method for filling such a deodorant dispenser with a deodorant mass according to claim 27, a method for filling such a refill pack with a deodorant mass according to claim 28, as well as a method for refilling such a deodorant dispenser with a refill pack according to claim 29 or 30. Advantageous embodiments and developments of the invention constitute the subject matter of the subclaims.

Terms such as "lower" and "upper" in the following always refer to a position of the deodorant dispenser, or refill pack respectively, in which the deodorant mass can be removed from the upper end of the deodorant dispenser or refill pack. This position generally corresponds to the storage and usage position of the deodorant dispenser.

A first aspect of the invention relates to a deodorant dispenser comprising a container having a wall enclosing an interior space of the container and a rotary body which is rotatably connected to the container and comprising a first coupling for the rotationally conjoint and form-fit separable connection in the container's interior space to a second coupling, wherein at least one continuous closable opening is formed in the deodorant dispenser from a lower exterior side of the deodorant dispenser to an upper end of the container's interior space.

The deodorant mass is preferably of a solid but yielding consistency which is transferable to the skin by rubbing it thereon.

The continuous closable opening allows the deodorant dispenser to be filled with the deodorant mass. To that end, the deodorant mass is usually heated prior to filling, thereby being liquefied, and poured into the deodorant dispenser as a liquid. The deodorant mass assumes its solid consistency after cooling. Preferably, this filling occurs as the initial filling during the production process of the deodorant dispenser in a filling facility. The production can thereby also be divided among different companies, whereby in particular the production of the deodorant dispenser itself can occur at a plastics processing company and the filling at a cosmetics manufacturer or at a respective subcontractor of one of these companies.

Preferably, the continuous closable opening runs through the first coupling of the rotary body.

The deodorant dispenser can be coupled to an elevator and a spindle able to convey a deodorant mass upwards via the first coupling. The container of the deodorant dispenser is preferably open at the upper end. Further preferably, the container comprises a removable closure, in particular a cover cap, which closes the upper open end of the container and which can be removed by the user in order to open the container at its upper end. The deodorant mass can thereby be taken from the upper end of the container and further deodorant mass conveyed upwards.

After the deodorant mass has been completely used up and discarded, the spindle and the elevator can be removed for the purpose of refill pack replacement. As such, the deodorant dispenser can be used multiple times, thereby saving material.

The feasibility of both an initial filling as well as a refilling of the deodorant dispenser enables the manufacturer to offer the deodorant dispenser either as an initially filled deodorant dispenser not intended for refilling, an initially filled and refillable deodorant dispenser, or as an empty and refillable deodorant dispenser without thereby needing to develop different deodorant dispensers. This allows the manufacturer to react flexibly to customer demands.

The feasibility of an initial filling additionally enables the user to use the deodorant dispenser immediately after purchase without having to deal with the refill procedure. The user does not have to purchase a refill pack and deal with the steps required in inserting the refill pack until after the initial filling has been used up, when the user is already familiar with the function of the deodorant dispenser through prolonged use. This makes the deodorant dispenser easier and more convenient for the user to use.

The advantages as described for both the manufacturer and the user result in an improved deodorant dispenser and therefore solve the task of the invention.

Preferential embodiments of the deodorant dispenser will be described in the following, each of which can be combined with one another in any desired manner unless doing so is expressly excluded or technically impossible.

According to one preferential embodiment, the container exhibits at least one first sealing element, particularly a cylindrical seal or an elastomer seal, in particular a rubber seal, which seals an area between the container and the rotary body. This thereby ensures an increase in the deodorant mass's longevity by, in particular, not drying out and/or no material being evaporated from it while the rotary body nevertheless remains rotatable relative to the container.

According to one preferential embodiment, the first coupling comprises at least one first latching element for latching with a second latching element of the second coupling and thus producing a rotationally conjoint, form-fit connection of the first coupling to the second coupling. The first coupling further comprises at least one first separator element for interacting with a second separator element of the second coupling and thus for disengaging the first latching element and the second latching element and for disconnecting the rotationally conjoint, form-fit connection of the first coupling to the second coupling.

This thereby creates a stable form-fit connection between the first coupling and the second coupling, yet one which can easily be disengaged again by moving the separator elements toward one another.

While a preferably empty deodorant dispenser can be realized with the previously described embodiments, the embodiments described below correspond to an initially filled deodorant dispenser.

According to one preferential embodiment, the deodorant dispenser further comprises a spindle having a second coupling connected in rotationally conjoint, form-fit manner to the first coupling. The spindle thereby has an external thread and is arranged within the container and substantially parallel to its longitudinal axis. The deodorant dispenser further comprises an elevator which extends inside the container substantially in at least a direction orthogonal to the spindle and is not rotatable relative to the container's wall. It exhibits an internal thread in which the external thread of the spindle runs.

The at least one continuous opening in the deodorant dispenser as previously mentioned above extends from the lower exterior side of the deodorant dispenser through or past the elevator to the upper end of the container's interior space. Thus, with the spindle and elevator inserted, the preferably liquefied deodorant mass can be filled into the deodorant dispenser through this opening from below. The deodorant mass then preferably hardens and adheres to the elevator. Further preferably, this ensues by a combination of form-fit and material bond, in that the deodorant mass penetrates into cavities in the elevator where it adheres.

Preferably, the continuous closable opening runs through the first coupling of the rotary body and through the second coupling of the spindle.

The container, the rotary body, the spindle and the elevator are connected together such that rotating the rotary body results in a joint rotation of the first and second coupling and thus also of the spindle in an ascending or in a descending direction, via which the elevator—and thus the entire deodorant mass—is moved upward or downward respectively, and such that when the elevator is in an end position at an upper end of the spindle, rotating the rotary body, preferably in the descending direction, further preferably in the ascending direction, results in the disconnecting of the connection of the first coupling to the second coupling.

This embodiment is on the one hand advantageous due to the deodorant dispenser in the assembled state being able to be filled with the deodorant mass through the opening extending from the lower exterior side of the deodorant dispenser through the elevator and, on the other hand, it enables the discarding of the spindle, the second coupling and the elevator after the deodorant mass has been used up, whereby the deodorant dispenser can be readied to be refilled with a refill pack.

According to one preferential variant of this embodiment, the spindle has a first latching means, preferably at its lower end, and the elevator has a second latching means, preferably at its lower end, whereby the elevator is configured such that rotating the rotary body in the descending direction, until the elevator is situated in an end position at a lower end of the spindle, results in the first latching element latching with the second latching element.

This has the advantage of thus being able to fix the rotational position of the spindle and thereby the second coupling relative to the elevator. Moreover, since the elevator is not rotatable relative to the container, the rotational position of the second coupling relative to the container is thereby also fixed. This facilitates the assembly of the deodorant dispenser when the rotational position of the first coupling is thereby also fixed since the first and second coupling can then be fit in a precisely fixed rotational position relative to one another.

The first latching means is preferably a notch in an upper surface of a flange-like widening at the lower end of the spindle. The second latching means is preferably a corresponding projection at the lower end of the elevator. In a specific rotational position of the elevator relative to the spindle when the elevator is situated at the lower end of the spindle, the projection on the elevator can then latch into the notch in the spindle.

According to a further preferential variant of this embodiment, the spindle exhibits a blocking region at its upper end at which the elevator is blockable in the end position at the upper end of the spindle. "Blockable" is to hereby mean that the elevator cannot be rotated relative to the spindle.

Preferably, the blocking of the elevator occurs by it hitting a limit stop in the blocking region of the spindle. The elevator can, however, also be latched in the blocking region. Although should the elevator only run up against a limit stop, it can be easily rotated back again upon reaching the limit stop without having to overcome any latched resistance.

What blocking the elevator in the end position at the upper end of the spindle achieves is further rotating of the rotary body not being able to be directly converted into a further rotational movement of the spindle. The resulting force can be used to release the form-fit engagement of the first coupling with the second coupling.

According to one preferential embodiment, the second coupling has at least one second latching element latched to the first latching element of the first coupling so that the first coupling is connected to the second coupling in rotationally conjoint and form-fit manner. The second coupling further comprises at least one second separator element for interacting with the first separator element of the first coupling and, when the elevator is situated in the end position at the upper end of the spindle, disengaging the first latching element and the second latching element and disconnecting the rotationally conjoint, form-fit connection of the first coupling to the second coupling.

According to one preferential variant of this embodiment, the at least one first separator element and the at least one second separator element together form a wedge mechanism. To that end, the first and the second separator element preferably each exhibit an inclined surface which abut each other and can displace against each other, particularly by means of a rotational movement. A wedge mechanism has the advantage of being able to convert a rotational movement into a rotational and linear movement of the second separator element away from the first separator element.

This thereby uncouples the form-fit engagement and separates the second coupling from the first coupling.

According to one preferential variant of this embodiment, the at least one first separator element and the at least one second separator element each exhibit at least six, preferably at least eight, further preferably at least twelve inclined surfaces. This has the advantage of the first and the second separator element not needing to be as precisely aligned with one another during assembly.

According to a further preferential variant, the at least one first separator element and the at least one second separator element together form a bayonet catch. A bayonet catch is normally understood to be a locking device which is locked by a rectilinear movement and subsequent rotational motion, wherein engagement preferably occurs at the end of the rotational movement, and which can be opened again by reversing the movements.

This has the advantage of preventing accidental rectilinear removal of the spindle and the elevator and the connection only being able to be disengaged by rotating the rotary body. Similarly, a bayonet catch can be designed such that the manufacturer can easily dictate whether the connection can be disengaged by rotating the rotary body in the ascending direction and/or the descending direction.

According to one preferential embodiment, the elevator and the spindle are configured such that the elevator at least partially emerges from the container after reaching the upper end of the container and further rotation of the spindle results in rotation of the elevator relative to the container. This has the advantage of making it easy for the user to remove the spindle and elevator by grasping the elevator protruding from the container. In particular, this results in an additional option for removing the spindle and the elevator if they jam or should the disengaging of the first coupling from the second coupling malfunction for whatever reason.

According to one preferential variant, the elevator, when having at least partially emerged from the container, is configured such that after the elevator is further rotated about a specific angle relative to the container, the elevator is blocked relative to the container. The blocking thereby preferably results from the corresponding shaping to the elevator and/or container, which enter into a form-fit engagement after being further rotated about a specific angle.

This has the advantage of the energy of a further rotation of the rotary body no longer resulting in a rotation of the elevator but rather being used to disengage the connection of the first coupling and the second coupling.

According to a further preferential embodiment, the deodorant dispenser further comprises a deodorant mass which at least partially fills the interior space of the container. This corresponds to a deodorant dispenser with an initial filling. In this state, the deodorant dispenser can be sold as an immediately usable product, regardless of whether or not it is designed for refilling.

A second aspect of the invention relates to a refill pack for a deodorant dispenser according to one of the cited embodiments which comprises a refill container having a wall enclosing an interior space of the refill container, a refill spindle with a second coupling which is connectable to the first coupling of the deodorant dispenser's container so as to be in rotationally conjoint and form-fit engagement, wherein the refill spindle has an external thread and wherein the refill spindle is arranged within the refill container and substantially parallel to its longitudinal axis, and a refill elevator which extends inside the refill container substantially in at least a direction orthogonal to the refill spindle and is not rotatable relative to the refill container's wall and which exhibits an internal thread in which the external thread of the refill spindle runs.

At least one continuous closable opening is formed in the refill pack from a lower exterior side of the refill pack to an upper end of the refill container's interior space.

Preferably, the continuous closable opening runs through the second coupling of the refill spindle.

The refill container can thereby be inserted into the deodorant dispenser's container by a rectilinear motion such that the first coupling of the rotary body of the deodorant dispenser is connected to the second coupling of the refill spindle in a rotationally conjoint and form-fit manner and the deodorant dispenser container, the refill container, the rotary body, the refill spindle and the refill elevator are then connected together such that rotating the rotary body results in a joint rotation of the first coupling of the deodorant dispenser's rotary body and the second coupling of the refill spindle and thus also of the refill spindle in an ascending or in a descending direction, via which the refill elevator is moved upward or downward respectively, and such that when the refill elevator is in an end position at an upper end of the refill spindle, rotating the rotary body, preferably in the descending direction, further preferably in the ascending direction, results in the disengagement of the connection of the first coupling of the rotary body and the second coupling of the refill spindle.

From the user's perspective, the refill pack, after having been inserted into the deodorant dispenser, behaves like a previously initially filled deodorant dispenser according to one of the above-cited embodiments. Such a refill pack enables using one deodorant dispenser for multiple fillings of the deodorant mass, thereby saving material and costs and meeting the increasing demand for environmentally friendly packaging concepts.

According to one preferential embodiment, the second coupling has at least one second sealing element, in particular a lamellar seal or an elastomer seal, particularly a rubber seal, which seals a region between the second coupling and the refill container. The second sealing element is preferably formed integrally with the second coupling, in particular as a single injection-molded part made of plastic. Particularly preferentially, however, the second sealing element forms a separate component from the second coupling. In the latter case, a mono-material solution is preferential for recycling reasons; i.e. the second coupling and the separate second sealing element being made of the same material; although a combination of different materials can also be used. The second sealing element ensures that the longevity of the deodorant mass is increased, in particular by not drying out and/or material not being evaporated from it, as long as the refill pack has not yet been inserted into the container.

According to a further preferential embodiment, the second coupling is designed such that the first coupling of the deodorant dispenser's rotary body can be connected to the second coupling in a rotationally conjoint and form-fit manner in any rotational position of the second coupling. This has the advantage of no longer potentially needing to align the second coupling and/or the first coupling with one another. It is thereby preferential for the first and the second coupling to self-align when connecting, preferably by "sliding within one another," particularly by way of an external force applied during connection.

According to a further preferential embodiment, the refill spindle has a first latching means, preferably at its lower end, and the refill elevator has a second latching means, preferably at its lower end, wherein the refill elevator is configured such that rotating the rotary body of the deodorant dispenser in the descending direction until the refill elevator is in an end position at a lower end of the refill spindle results in the first latching element latching with the second latching element.

The first latching means is preferably a notch in an upper surface of a flange-like widening at the lower end of the refill spindle. The second latching means is preferably a corresponding projection at the lower end of the refill elevator. In a specific rotational position of the refill elevator relative to the refill spindle when the refill elevator is situated at the lower end of the refill spindle, the projection on the refill elevator can then latch into the notch in the refill spindle.

According to a further preferential embodiment, the refill spindle exhibits a blocking region at its upper end at which the refill elevator is blockable in the end position at the upper end of the spindle.

According to a further preferential embodiment, the second coupling has at least one second latching element able to be latched to a first latching element of the first coupling of the deodorant dispenser's rotary body so that the first coupling is connected to the second coupling in rotationally conjoint and form-fit manner. The second coupling further comprises at least one second separator element for interacting with a first separator element of the first coupling of the deodorant dispenser and, when the refill elevator is situated in the end position at the upper end of the refill spindle, disengaging the first latching element and the second latching element and disconnecting the rotationally conjoint, form-fit connection of the first coupling to the second coupling.

According to a preferential variant of this embodiment, the at least one second separator element is designed to form a wedge mechanism together with the at least one first separator element of the deodorant dispenser's first coupling.

According to one preferential variant of this embodiment, the at least one second separator element exhibits at least six, preferably at least eight, further preferably at least twelve inclined surfaces.

According to a further preferential variant, the at least one second separator element is designed to form a bayonet catch together with the at least one first separator element of the deodorant dispenser's first coupling.

According to one preferential embodiment, the refill elevator and the refill spindle are configured such that the refill elevator at least partially emerges from the refill container after reaching the upper end of the refill container and further rotation of the refill spindle results in rotation of the refill elevator relative to the refill container.

According to one preferential variant, the refill elevator, when having at least partially emerged from the refill container, is configured such that after the refill elevator is further rotated about a specific angle relative to the refill container, the refill elevator is blocked relative to the refill container. Here as well, the blocking preferably results from a corresponding shaping to the refill elevator and/or refill container, which enter into a form-fit engagement after being further rotated about a specific angle.

The last above-mentioned embodiments of the refill pack and its variants yield identical or equivalent advantages to the corresponding embodiments of the deodorant dispenser according to the first aspect of the invention and its variants.

According to a further preferential embodiment, the refill pack also further comprises a deodorant mass which at least partially fills the interior space of the refill container. This corresponds to a filled refill pack. In this state, the refill pack can be sold as a product to be used in conjunction with a deodorant dispenser according to the invention, and namely by itself or in combination with such a deodorant dispenser.

A third aspect of the invention relates to a deodorant dispenser system consisting of at least one deodorant dispenser according to the first aspect of the invention and at least one refill pack according to the second aspect of the invention.

According to one preferential embodiment of the deodorant dispenser system, the deodorant dispenser is a deodorant dispenser having a spindle and an elevator, wherein the spindle of the deodorant dispenser and the refill spindle of the at least one refill pack are structurally identical and/or the elevator of the deodorant dispenser and the refill elevator of the at least one refill pack are structurally identical or are structurally identical save for slightly differing external dimensions. The partly identical components enables saving costs relative to multiple development and multiple manufacture of injection molds for different spindles/elevators.

A minor change in the external dimensions of the refill elevator relative to the elevator may be required since the internal dimensions of the refill pack's refill container are slightly smaller than the internal dimensions of the deodorant dispenser's container due to the former needing to be able to be inserted into the latter. If the elevator and the refill elevator are structurally identical, in particular with the slightly smaller refill elevator external dimensions, a gap occurs between the external side of the elevator and the internal side of the deodorant dispenser's container, as a result of which the deodorant mass could adhere to the internal side of the container, particularly in the case of deodorant mass of low viscosity. This can be prevented by slightly different external elevator and refill elevator dimensions.

The last-described aspects of the invention and embodiments thereof, which technically correspond to the features of the above-described deodorant dispenser, also yield the same advantages as previously described above.

A fourth aspect of the invention relates to a method for filling a deodorant mass into a deodorant dispenser according to the first aspect of the invention which already has a spindle and an elevator but not yet any deodorant mass, comprising the steps:

- bringing the deodorant dispenser into a position in which the lower exterior side of the deodorant dispenser faces upwards;
- liquefying the deodorant mass;
- filling the deodorant mass into the container of the deodorant dispenser through the lower exterior side of the deodorant dispenser into the at least one continuous closable opening in the deodorant dispenser;
- closing the at least one continuous closable opening in the deodorant dispenser; and
- solidifying the deodorant mass.

This therefore relates to a method for the initial filling of an inventive deodorant dispenser.

A fifth aspect of the invention relates to a method for filling a deodorant mass into a refill pack according to the second aspect of the invention which does not yet have any deodorant mass, comprising the steps:

- bringing the refill pack into a position in which the lower exterior side of the refill pack faces upward;
- liquefying the deodorant mass;
- filling the deodorant mass into the refill container of the refill pack through the lower exterior side of the refill pack into the at least one continuous closable opening in the refill pack;

closing the at least one continuous closable opening in the refill pack; and solidifying the deodorant mass.

The method for filling the inventive refill pack thus proceeds completely analogously to the method according to the fourth aspect of the invention for filling an inventive deodorant dispenser (i.e. for the initial filling of the deodorant dispenser).

It is therefore also possible to fill an inventive deodorant dispenser and an inventive refill pack on the same filling device. The filling device can be a conventional filling device for deodorant mass.

A sixth aspect of the invention thus relates to the use of a filling device for deodorant mass, whereby at least one deodorant dispenser according to the first aspect of the invention and at least one refill pack according to the second aspect of the invention, neither of which are yet filled with deodorant mass, are filled on the filling device in any order in a method pursuant to the fourth or respectively fifth aspect of the invention.

Since the product to be filled; i.e. the deodorant dispenser or the refill pack, each has the same "interface" to the filling device; i.e. the continuous closable opening from its lower exterior side to an upper end of the interior side of its container or respectively refill container, the filling device can also be used without significant changes both for filling a deodorant dispenser according to the invention as well as for filling a refill pack according to the invention, and do so in any order.

This can thereby achieve enormous cost savings since no additional filling device needs to be developed and constructed for the inventive refill packs.

A seventh aspect of the invention relates to a method for refilling a deodorant dispenser according to the first aspect of the invention which does not have a spindle, elevator or deodorant mass with a refill pack according to the second aspect of the invention, comprising the step:

inserting the refill container into the container of the deodorant dispenser by a rectilinear movement until the first coupling of the rotary body of the deodorant dispenser is connected to the second coupling of the refill spindle of the refill pack in a rotationally conjoint and form-fit engagement.

A rectilinear insertion movement makes refilling particularly user-friendly. This reduces the risk of incorrect insertion and damaging of the material.

An eighth aspect of the invention relates to a method for refilling a deodorant dispenser according to the first aspect of the invention which already has a spindle and an elevator with a refill pack according to the second aspect of the invention, comprising the steps:

rotating the rotary body of the deodorant dispenser in the ascending direction until the elevator is in the end position at the upper end of the spindle;

rotating the rotary body of the deodorant dispenser, preferably in the descending direction, further preferably in the ascending direction, thereby disengaging the connection of the first coupling of the rotary body to the second coupling of the spindle;

removing the spindle with the second coupling and the elevator from the container; and inserting the refill pack into the container of the deodorant dispenser by a rectilinear movement until the first coupling of the rotary body of the deodorant dispenser is connected to the second coupling of the refill spindle of the refill pack in a rotationally conjoint and form-fit engagement.

These steps are independent of whether there is still deodorant mass within the container of the deodorant dispenser, and if so, how much, since any remaining deodorant mass is carried upward together with the elevator in the first step and can be removed from the container together with the spindle and the elevator in the third step.

Due to the connection of the first coupling of the rotary body to the second coupling of the spindle being disengaged in the same way as when the deodorant dispenser is used; i.e. rotating the rotary body, this is particularly easy for the user to do. Accidental disengaging of the coupling while the deodorant dispenser is still in use is likewise prevented, as this does not occur until the elevator is at the upper end of the spindle. Refill preparation is thus particularly easy for the user.

The described aspects of the invention lead to the desired manufacturer flexibility of being able to offer the inventive deodorant dispenser either in an initially filled and non-refillable form, in an initially filled and refillable form, or in an empty and refillable form.

The latter could for example be in the form of a "starter kit" consisting of an empty deodorant dispenser and a refill pack. This concept would particularly yield a pronounced learning effect for the user should he have to fit the refill pack into the empty deodorant dispenser himself.

Further advantages, features and possible applications of the present invention derive from the following detailed description in conjunction with the figures.

Figure 1A:
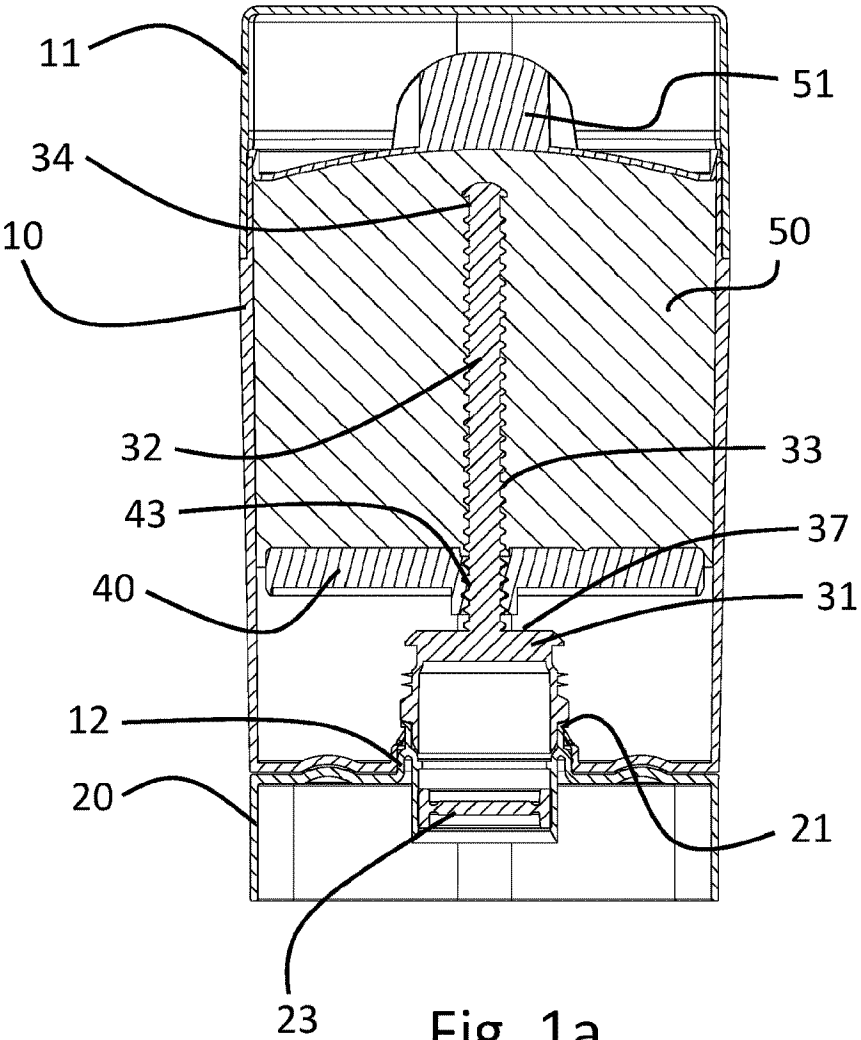
Figure 2B:
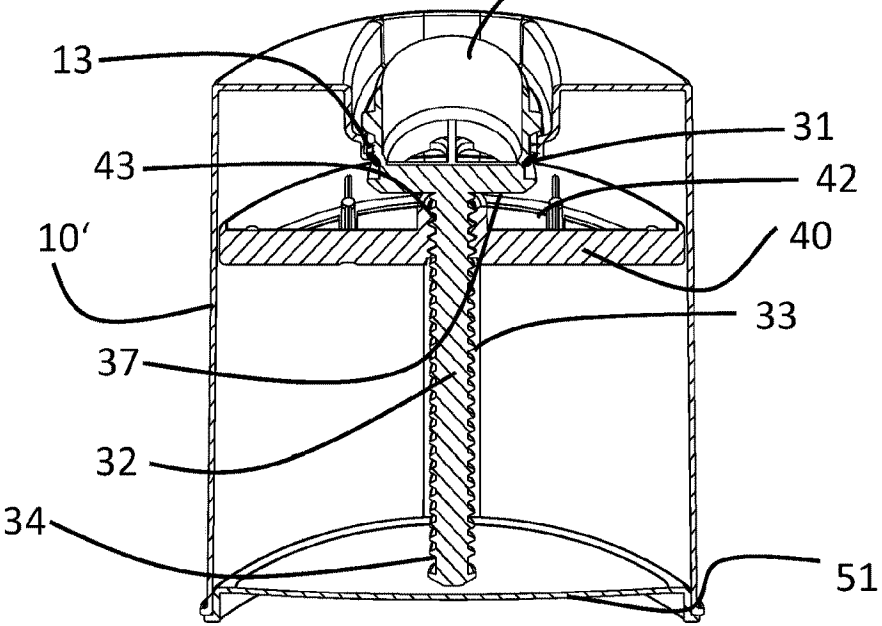
Figure 2A:
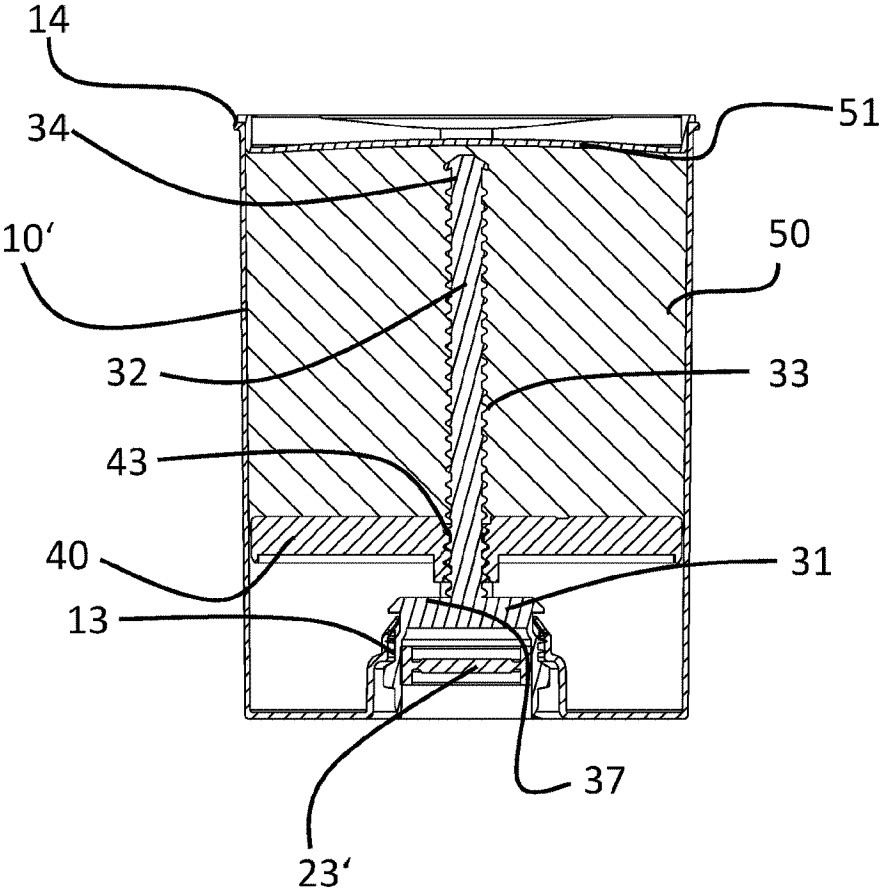
Figure 3B:
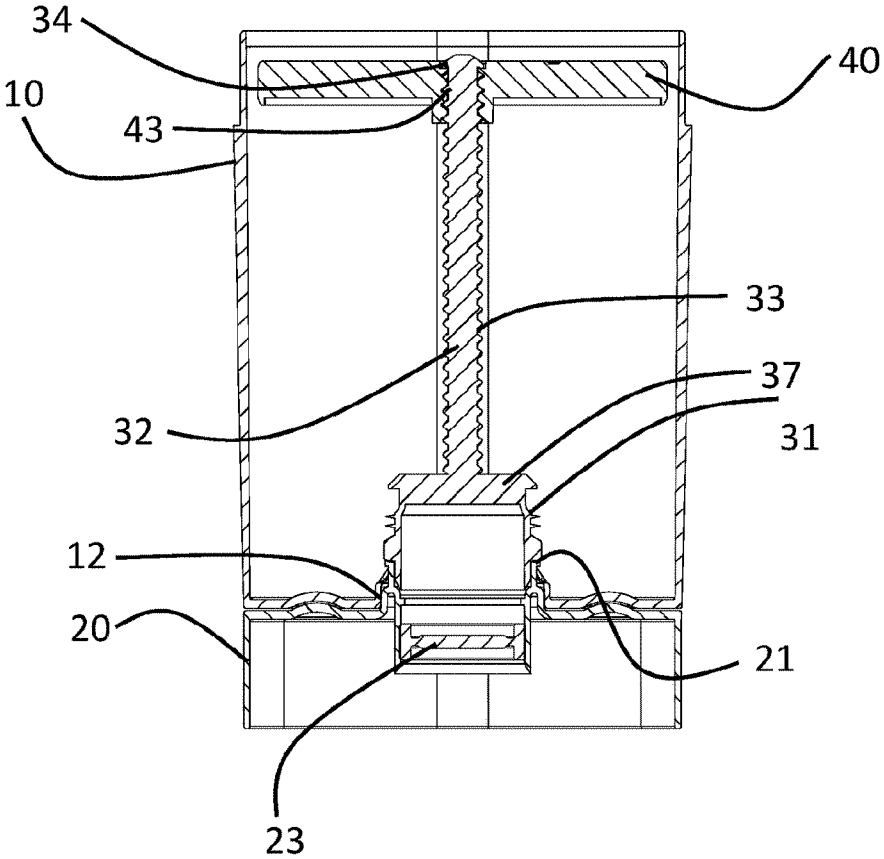
Figure 3A:
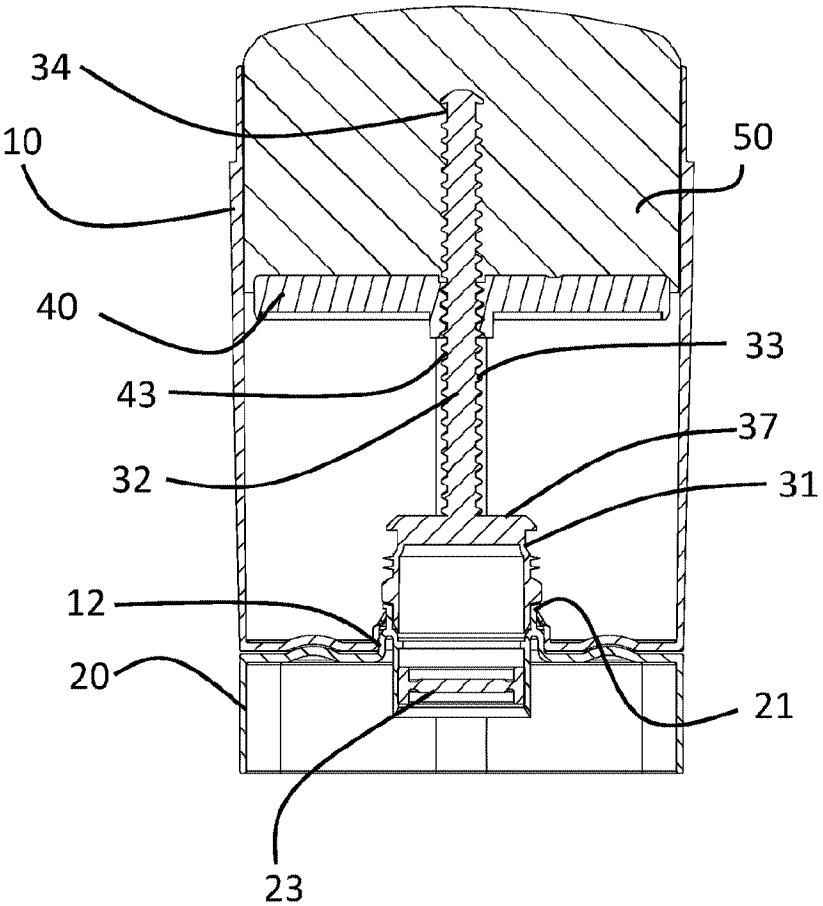
Figure 3D:
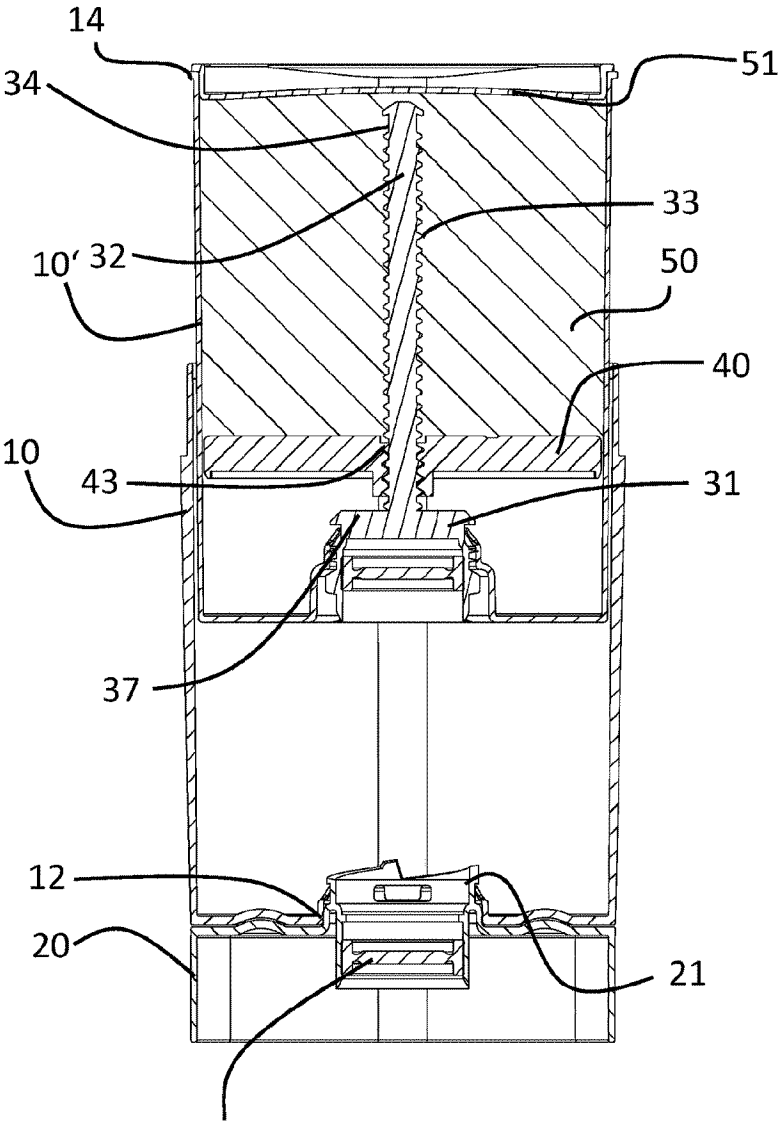
Figure 3C:
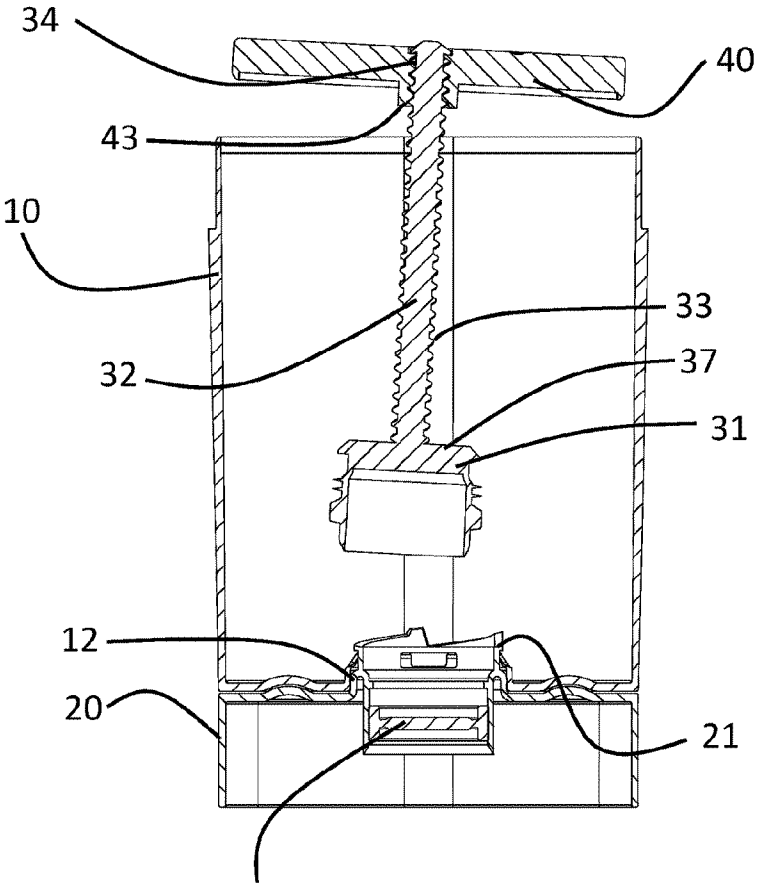
Figure 4C:
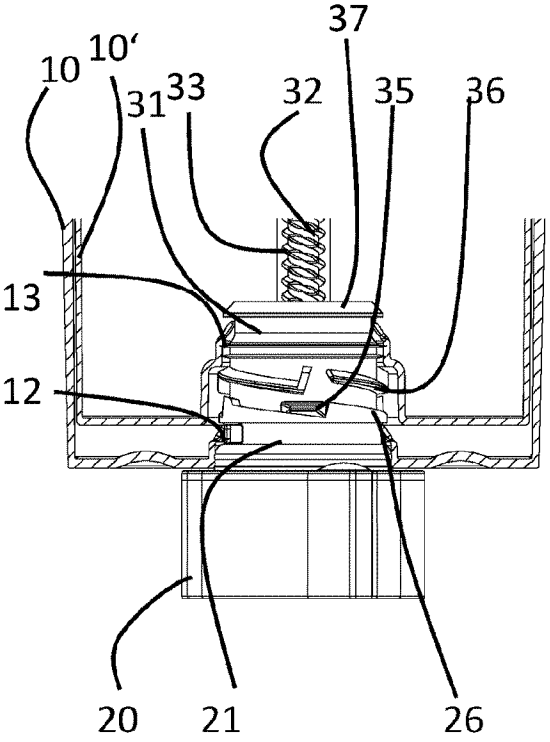
Figure 4B:
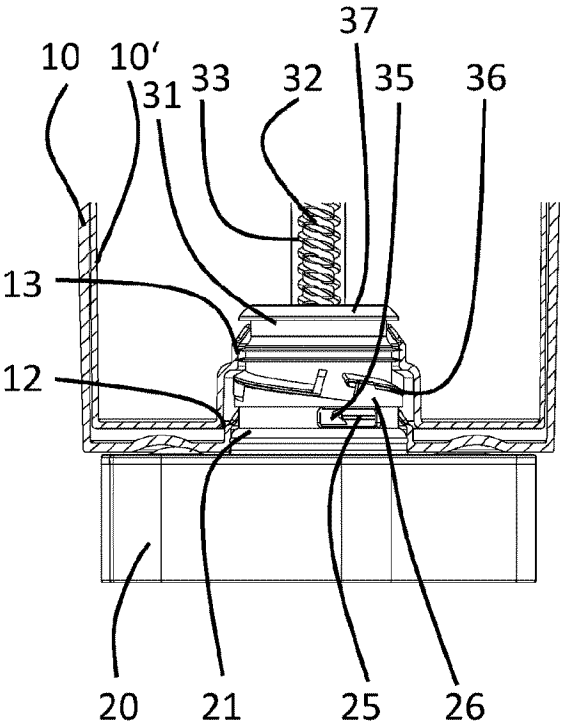
Figure 4A:
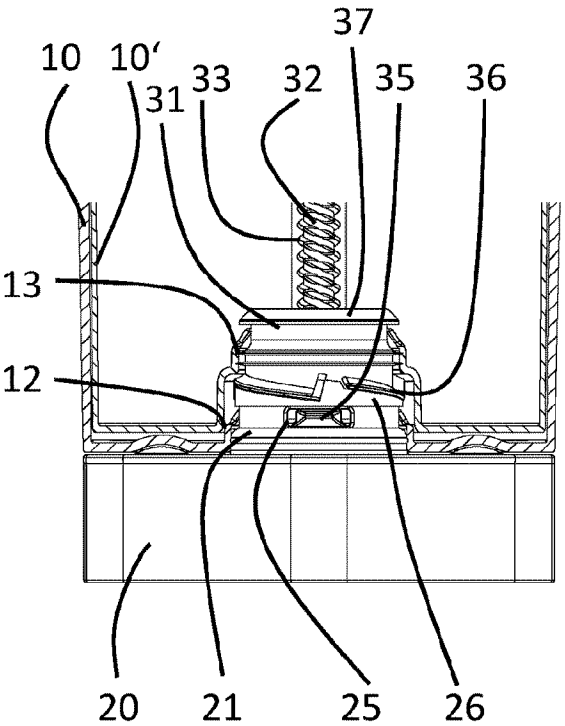
Figure 5B:
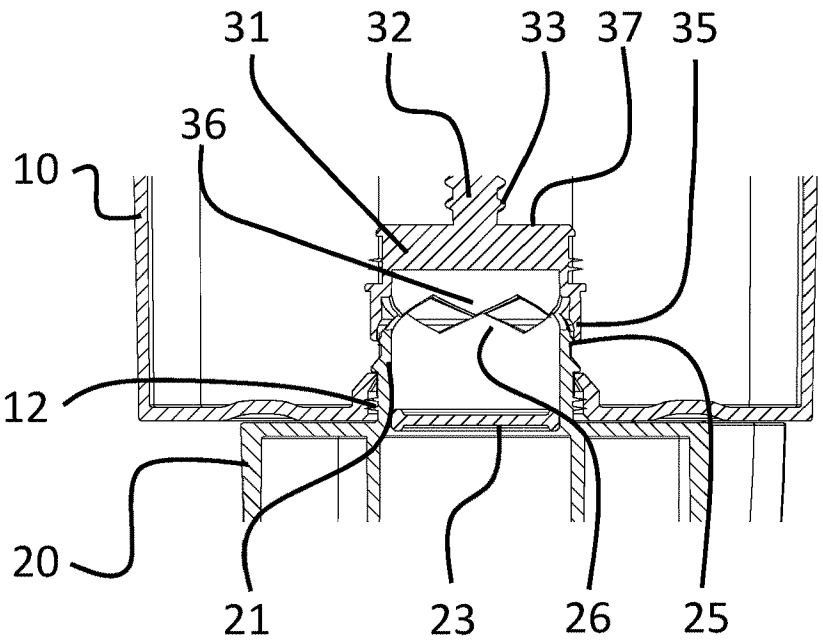
Figure 5A:
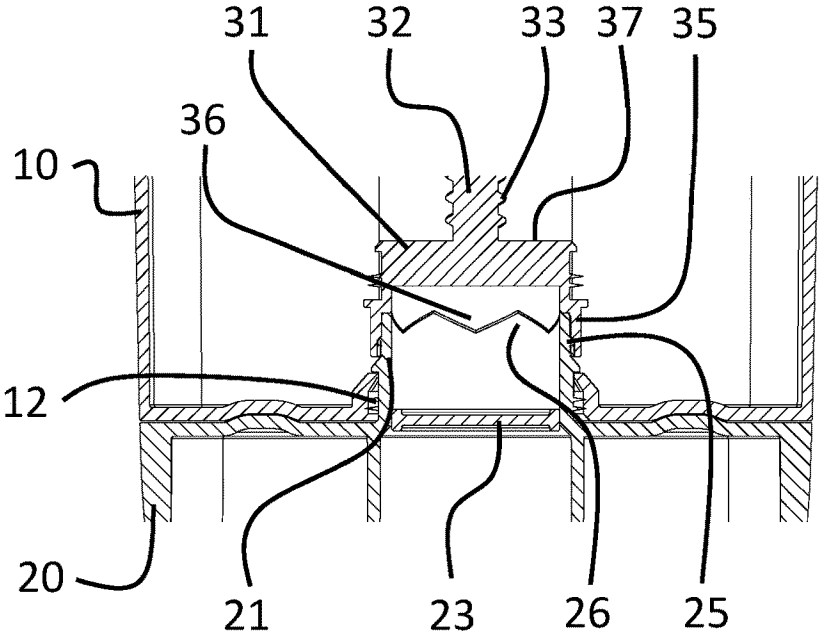
Figure 6C:
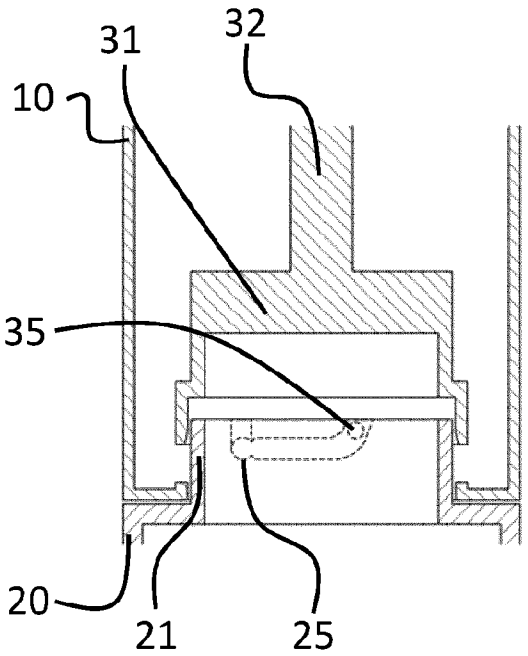
Figure 6B:
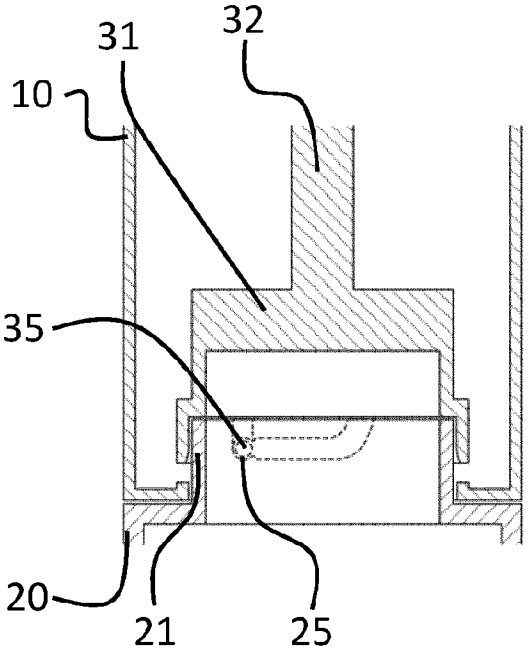
Figure 6A:
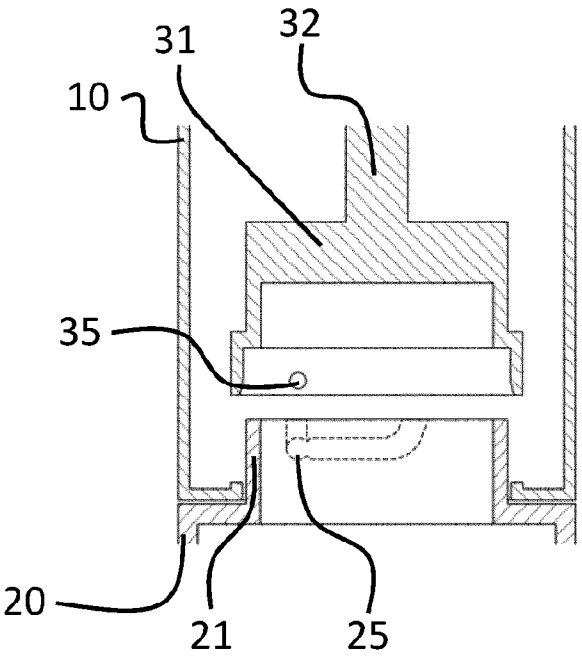
Figure 7B:
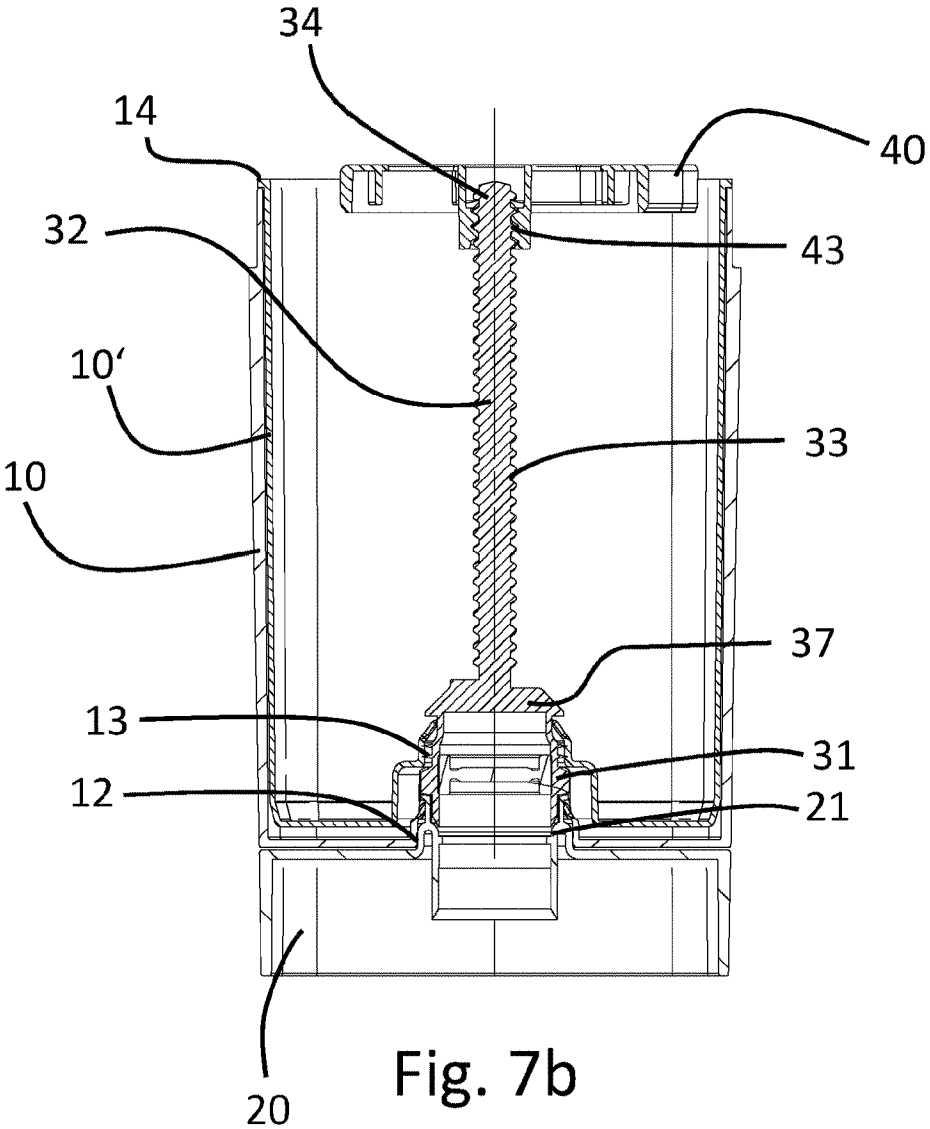
Figure 7A:
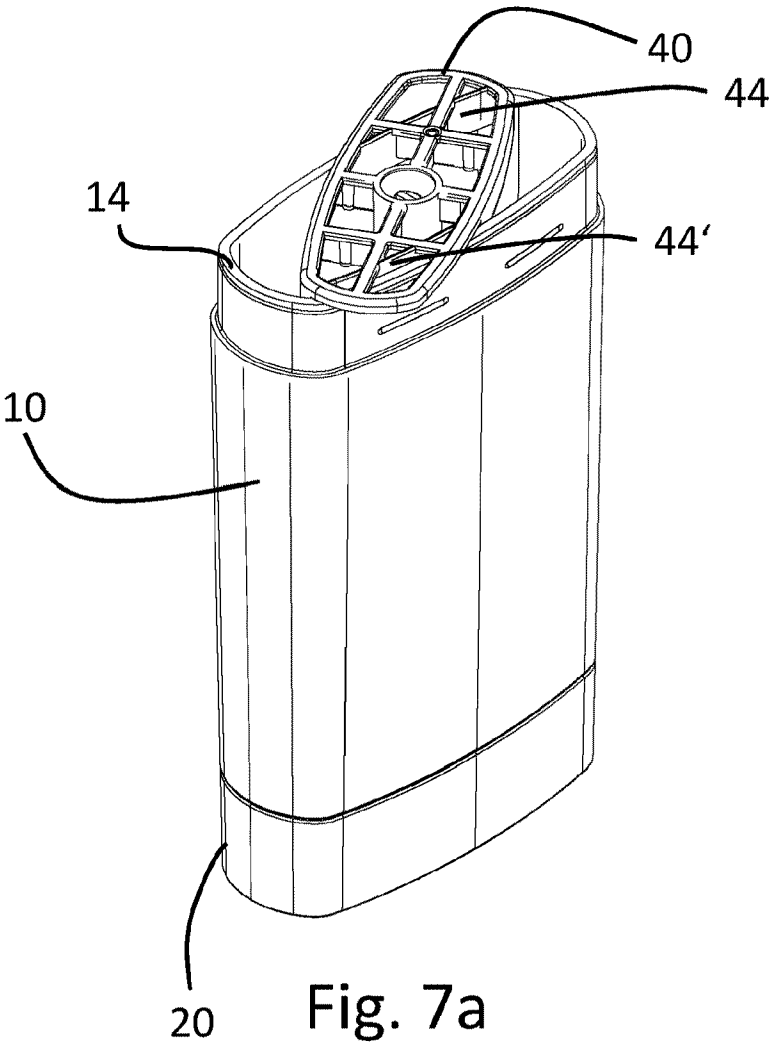
Figures 8A, 8B, 8C, 8D:
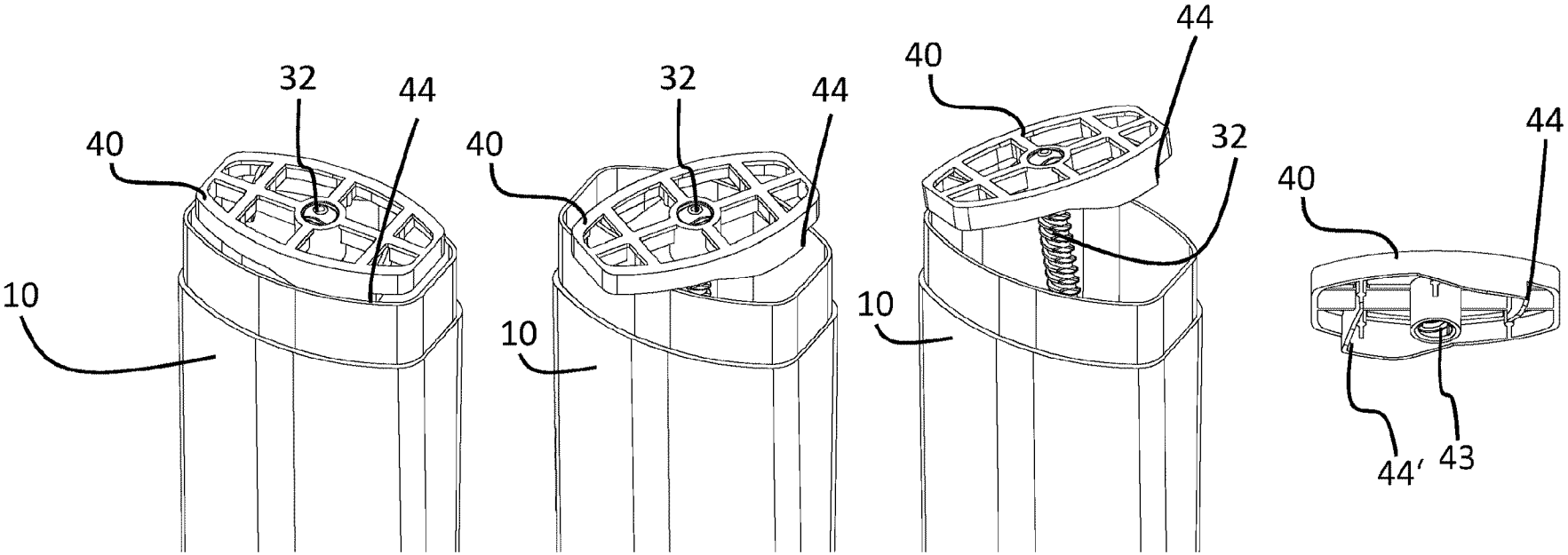

Shown are:

FIG. 1*a* a schematic cross section through a plane containing the vertical axis of the container of a filled deodorant dispenser according to the invention;

FIG. 1*b* a schematic oblique view of a filled deodorant dispenser according to the invention with the underside of the container facing upward;

FIG. 2*a* a schematic cross section through a plane containing the vertical axis of the container of a filled refill pack according to the invention;

FIG. 2*b* a schematic oblique view of a filled refill pack according to the invention with the underside of the container facing upward;

FIG. 3*a-d* respective schematic cross sections through a plane containing the vertical axis of the container of an inventive filled deodorant dispenser in different states, namely:

FIG. 3*a* the deodorant dispenser partially filled with a deodorant mass in the state of use;

FIG. 3*b* the deodorant dispenser after the deodorant mass has been used up and the elevator is situated at the upper end of the spindle;

FIG. 3*c* the deodorant dispenser after the form fit of the first coupling to the second coupling has been disengaged;

FIG. 3*d* the deodorant dispenser upon insertion of a refill pack;

FIG. 4*a-c* a cross section through a plane containing the vertical container axis of the lower part of the deodorant dispenser, the rotary body and the two couplings upon disengagement of the form-fit engagement of the two couplings;

FIG. 5*a-b* a cross section through a plane containing the vertical container axis of the lower part of a further inventive embodiment of the deodorant dispenser, the rotary body and the two couplings upon disengagement of the form-fit engagement of the two couplings;

FIG. 6*a-c* a cross section through a plane containing the vertical container axis of the lower part of a further inventive embodiment of the deodorant dispenser, the rotary body and the two couplings upon the engaging into and disengaging of the form-fit engagement of the two couplings;

FIG. 7*a* an oblique view from above of a deodorant dispenser having a refill pack, with a refill elevator partially emerged from the container and rotated against the container;

FIG. 7*b* a cross section of the deodorant dispenser having a refill pack, with a refill elevator partially emerged from the container and rotated against the container;

FIG. 8*a-c* an oblique view from above of a deodorant dispenser with a refill elevator partially emerged from the container upon rotating against the container and removing the refill elevator; and FIG. 8*d* an oblique view from below of the refill elevator from FIGS. 8*a-c*.

The same reference numerals are used in the figures for the same or corresponding elements of the invention.

FIG. 1*a* and FIG. 1*b* show a schematic view of an inventive deodorant dispenser, whereby FIG. 1*a* shows a deodorant dispenser filled with deodorant mass 50 and FIG. 1*b* shows a schematic view of an empty deodorant dispenser diagonally from below. Pictured is a container 10 with a closure 11, with a rotary body 20 rotatably affixed on the underside, wherein the connecting area is sealed by a first sealing element 12, a cylinder seal. This prevents the deodorant mass 50 in the container 10 from drying out. The first coupling 21, which is connected to the second coupling 31 in rotationally conjoint and form-fit manner, is located on and integrally connected to the rotary body 20. A spindle 32 with an external thread 33 is integrally fixed to the second coupling 31. An elevator 40 is situated orthogonal to the spindle 32; the external thread 33 of the spindle 32 engaging in its internal thread 43. The deodorant mass 50 conveyed by the elevator 40 is situated above the elevator 40 in FIG. 1*a*. Rotation of the rotary body 20 is transmitted to the spindle 32 via the first coupling 21 and the second coupling 31. This results in an upward or downward movement of the elevator 40 and thus the deodorant mass 50. A multi-piece implementation of the rotary body 20 and the first coupling 21, or the spindle 32 and the second coupling 31 respectively, is of course also conceivable.

The deodorant dispenser in the figures comprises a container 10 and an elevator 40, each exhibiting not a round cross section but rather an e.g. oval or lenticular cross section (see in particular FIG. 5*a*) so that already by virtue of this shaping, the elevator 40 is not rotatable within the container 10 relative to same. This does not, however, constitute a limitation of the invention. The deodorant dispenser can also comprise a container 10 and an elevator 40 with a round cross section. Additional elements must then be provided in order to prevent the concurrent rotating of the elevator 40 within the container 10, for instance radial projections on the external side of the elevator 40 to run in corresponding axial grooves in the internal side of the container 10.

For the initial filling, the container 10 is inverted and a liquefied deodorant mass 50 flows into the container 10 through the coupling opening 22 in the first coupling 21 and the elevator opening 42 in the elevator 40 onto the deodorant cover cap situated at the upper end of the container 10 (thus downward in the position shown in FIG. 1*b*). The container 10 is filled with the deodorant mass 50 until it reaches the elevator 40 and also pushes through the elevator opening 42. The coupling opening 22 is then closed by a plug 23. The plug 23 can in particular consist of a rigid plastic element or even a film. After the deodorant mass 50 has hardened, in particular by cooling, the deodorant dispenser can be returned to its normal position again and is ready for use.

FIG. 2*a* and FIG. 2*b* show a schematic view of an inventive refill pack, whereby FIG. 2*a* shows a refill pack filled with deodorant mass 50 and FIG. 2*b* shows a schematic view of an empty deodorant dispenser diagonally from below. Pictured is a refill container 10' with a deodorant cover cap 51 and a closure 11. The refill container 10' is preferably thin-walled (for example having the wall thickness of a yogurt cup) and thus lightweight and material-saving. The deodorant cover cap 51 can in particular consist of a rigid plastic element or even a film. The second coupling 31 rotatably connected to the refill container 10' is situated at the lower end, whereby the connecting area between the second coupling 31 and the refill container 10' is sealed by a second sealing element 13, a lamellar seal. This prevents the deodorant mass 50 in the refill container 10' from drying out. A refill spindle 32 with an external thread 33 is integrally fixed to the second coupling 31 and a refill elevator 40 connected to the external thread 33 of the refill spindle 32 via an internal thread 43 is located orthogonal to the refill spindle 32. The thin walls of the refill container 10' enable realizing the refill elevator 40 with the same outer diameter as with an elevator 40 for a initially-filled deodorant dispenser, particularly even structurally identical to it, since the inner diameter of the container 10 of the deodorant dispenser and the inner diameter of the refill container 10' differ only slightly.

The deodorant mass 50 conveyed by the refill elevator 40 is situated above the refill elevator 40 in FIG. 2*a*. Rotation of the second coupling 31 is transmitted to the refill spindle 32. This results in an upward or downward movement of the refill elevator 40 and thus the deodorant mass 50. Here as well, a multi-piece implementation of the refill spindle 32 and the second coupling 31 is of course also conceivable.

For filling, the refill container 10' is inverted and a liquefied deodorant mass 50 flows into the refill container 10' through the coupling opening 22 and the elevator opening 42 in the refill container 10' onto the deodorant cover cap situated at the upper end of the refill container 10' (thus downward in the position shown in FIG. 2*b*). The refill container 10' is filled with the deodorant mass 50 until it reaches the elevator 40 and also pushes through the elevator opening 42. The coupling opening 22 is then closed by a plug 23'. The plug 23' can in particular consist of a rigid plastic element or even a film. After the deodorant mass 50 has hardened, the refill pack can be returned to its normal position again and is ready for use.

FIGS. 3*a-d* show schematic cross sections through a plane containing the vertical axis of the container of an inventive filled deodorant dispenser in different states.

FIG. 3*a* shows the deodorant dispenser partially filled with a deodorant mass 50 in the state of use. Before use, the rotary body 20 is rotated in the ascending direction, whereby the elevator 40 conveys the deodorant mass 50 upward.

FIG. 3*b* shows the deodorant dispenser after the deodorant mass 50 has been used up and the elevator 40 is situated at the upper end of the spindle 32 at the blocking region 34. Because the elevator 40 is blocked, a further rotation of the rotary body 20 does not result in an ascending or descending movement of the elevator 40 but rather exerts a force between the first coupling 21 and the second coupling 31 which is used to disconnect the form-fit engagement of the first coupling 21 to the second coupling 31. To that end, the spindle 32 and the elevator 40 are to be designed such that they withstand the cited force, which in particular constitutes a torsional force, without significant deformation since such a deformation could lead to a malfunction when the form-fit engagement between the first coupling 21 and the second coupling 31 is released.

FIG. 3*c* shows the deodorant dispenser after the disengaging of the form fit between the first coupling 21 and the second coupling 31. The second coupling 31, the spindle 32 and the respectively associated elevator 34 can be removed from the container 10 together and recycled.

FIG. 3*d* shows the deodorant dispenser after the second coupling 31, the spindle 32 and the associated elevator 34 have been removed from the container 10 and while a refill pack is subsequently being inserted. The refill container 10' is inserted rectilinearly into the container 10 until the second coupling 31 of the refill pack engages with the first coupling 21 of the deodorant dispenser in form-fit manner. Depending on how the first coupling 21 and the second coupling 31 are designed, it is advantageous for the rotational position of the second coupling 31 to be aligned with the rotational position of the first coupling 21 prior to the insertion of the refill pack in order to ensure an effective form fit. The deodorant cover cap 51 is thereafter removed and the deodorant dispenser can continue to be used in the same way as after the initial filling.

Located at the upper end of the refill container 10' is a removal flange 14 which exhibits a slightly larger diameter than the refill container 10' and which protrudes upward for the user to grasp when the form fit between the first coupling 21 and the second coupling 31 is disengaged, thereby facilitating a later removal of the refill container 10' from the container 10.

FIGS. 4*a-c* show a cross section through a plane containing the vertical container axis of the lower part of the deodorant dispenser, the rotary body 20 and the two couplings 21, 31 upon release of the form-fit engagement of the two couplings 21, 31. FIG. 4*a* shows the first coupling 21 in form-fit engagement with the second coupling 31. The first coupling 21 comprises a first latching element 25 which is realized by way of a window in the side wall of the first coupling. The second latching element 35, which is integrally connected to the second coupling 31, is seated in this window. Since the second latching element 35 nearly fills the window, a rotationally conjoint and form-fit connection exists at this point. A force which is able to deform the material of the first coupling 21 in the area of the first latching element 25 so as to uncouple the form fit is needed in order to disengage said form fit. The first coupling 21 further comprises a first separator element 26 in the form of an inclined surface which engages with a second separator element 36 of the second coupling, likewise an inclined surface. The first separator element 26 and the second separator element 36 together form a wedge mechanism.

When the elevator 40 reaches the upper end of the spindle 32, the elevator 40 is then blocked at this height at the blocking region 34 on the spindle 32. This results in the spindle 32 being prevented from further rotation. FIG. 4*b* shows this situation of the spindle 32 prevented from further rotation but the rotary body 20 being further rotated. When the first coupling 21 rotates against the second coupling 31, the second latching element 35 is pushed out of the first latching element 25, whereby the material of the first coupling 21 is deformed in the area of the first latching element 25 by the outwardly conically tapering shape of the second latching element 35 to the extent that the second latching element 35 slips under the first coupling 21. The wedge mechanism 26, 36 further converts the rotational movement into a linear movement of the second coupling 31 away from the first coupling 21, whereby the two couplings 21, 31 are separated as depicted in FIG. 4*c*.

Configuring the wedge mechanism with more teeth is likewise advantageous, whereby although the force exerted in disengaging the form-fit engagement increases, the rotational position of the second coupling 31 no longer needs to be aligned with the rotational position of the first coupling 21, thereby making the insertion of a refill pack easier.

Such a wedge mechanism is depicted in FIG. 5*a* and FIG. 5*b* which show a cross section through a plane containing the vertical container axis of the lower part of a further inventive embodiment of the deodorant dispenser having a wedge mechanism with ten inclined surfaces, the rotary body 20 and the two couplings 21, 22 upon disengagement of the form-fit engagement of the two couplings 21, 22.

FIG. 5*a* shows the deodorant dispenser in form-fit engagement in which the second latching element 35 is engaged with the first latching element 25. As long as the second coupling 31 or spindle 32 respectively can rotate together with the first coupling 21 and the rotary body 20, the form-fit engagement is maintained.

FIG. 5*b* shows the deodorant dispenser with disengaged form fit. As soon as the rotational movement of the spindle 32 is blocked, in particular by a blocking of the elevator 40, the rotational movement of the rotary body 20 is no longer transmitted to the spindle 32 and thus to the second coupling 31, whereby the first coupling 21 rotates relative to the second coupling 31 upon rotation of the rotary body 20. Due to the wedge mechanism, consisting of the first separator elements 26 and the second separator elements 36, this results in a rectilinear upward movement of the second coupling 31 away from the first coupling 21.

The wedge mechanism depicted in FIG. 5*a* and FIG. 5*b* has symmetrical wedges (separator elements 26, 36), which is why after rotation of the second coupling 31 has been blocked as has rotation of the rotary body 20, both in the ascending direction as well as the descending direction, a releasing of the form-fit engagement of the first latching element 25 and the second locking element 35 results. Adapting the lead angle of the inclined surfaces of the separator elements 26, 36 (up to a vertical surface) enables achieving a disengaging of the form-fit engagement only upon rotation in one of the two directions, preferably the ascending direction.

It is likewise advantageous to configure the wedge mechanism with fewer teeth, whereby although the rotational position of the second coupling 31 needs to be aligned more precisely with the rotational position of the first coupling 21 when inserting a refill pack, the force required to disengage the form fit is reduced. Furthermore, such a wedge mechanism is easier to manufacture.

It is likewise advantageous to realize the form-fit engagement of the couplings 21, 31 using a bayonet catch, an embodiment which is shown FIGS. 6*a-c*. FIG. 6*a* shows the first coupling 21 and a second coupling 31 aligned thereon before they enter into form-fit engagement via a rectilinear movement. When pushed together rectilinearly, the second latching element 35 thereby latches into a first latching element 25 in which it is connected in form-fit and rotationally conjoint engagement with little rotational resistance, which is shown in FIG. 6*b*. When the elevator 40 reaches the upper end of the spindle 32 and is blocked there, the rotational movement can no longer be transmitted to the spindle 32 and results in a disengaging of the form-fit engagement in that the second latching element 35 is directed through an initially horizontal and then upwardly curved guideway and thereby pushed upward out of the first coupling 21. This results in the second latching element 35 and thus the second coupling 31 being moved upward away from the first coupling 21 upon the rotary body 20 being rotated. This is shown in FIG. 6*c*. Instead of a bayonet catch with a rectilinear insertion movement, a screw coupling with a helical insertion movement can also be used (not depicted).

Furthermore, the connection of the first coupling 21 to the second coupling 31 can also be disengaged when a part of the first coupling 21 and/or the second coupling 31 breaks, snaps or otherwise irreversibly separates upon the torque exceeding a specific value (likewise not depicted).

FIG. 7*a* shows an oblique view of a deodorant dispenser with a refill pack having a refill elevator 40 partially emerged from the container 10 and rotated against the container 100. FIG. 7*b* shows a cross section of the deodorant dispenser from FIG. 7*a*. When the refill elevator 40 is moved upward in the ascending direction by rotating the rotary body 20 so that the upper part of the refill elevator 40 protrudes from the container 10 (and thus also from the refill container 10') and the refill elevator 40 reaches the blocking region 34 of the refill spindle 32, the refill elevator 40 is no longer rotationally fixed relative to the refill container 10', and thus the container 10, by the shape of the refill container 10'. A further rotation of the rotary body 20 therefore results in a rotation of the refill elevator 40 relative to the container 10. After a further rotation about a specific angle of rotation, which is depicted in FIG. 7*a* and therein being approximately 30 degrees, the elevator blocking region 44, 44' abuts against the inner wall of the refill container 10' which prevents a further rotational movement of the refill elevator 40 relative to the refill container 10' and the container 10. In this position, the refill elevator 40 can be grasped more easily by the user and removed together with the refill container 10'.

The elevator blocking region 44, 44' consists of a rib arranged at the lower edge of the refill elevator 40, the angular position of which is offset relative to the outer wall of the refill elevator 40 by the above-cited angle (here approximately 30 degrees). The elevator blocking region 44, 44' can comprise individual sections arranged in the manner described which can be connected and thereby stabilized by further sections.

Lastly, the elevator blocking region 44, 44' can also exhibit one or more wedged ribs which taper inwardly downward (not depicted). This causes the refill elevator 40 which is blocked relative to the refill spindle 32 to be pushed upward by a further rotation due to said wedged ribs as soon as its elevator blocking region 44, 44' abuts against the inner wall of the refill container 10' subsequent rotation about the above-cited angle of rotation. As a result, the refill spindle 32 pulls the second coupling 31 upward and—given the appropriate design of the two couplings 21, 31—disengages the connection to the first coupling 21.

Also conceivable are elements which upwardly press the spindle or refill spindle 32 blocked relative to the elevator or refill elevator 40, and thereby the second coupling 31, from below upon a further rotation of the rotary body 20. This approach can also—with the appropriate design to the two couplings 21, 31—disengage the connection of the first coupling 21 to the second coupling 31.

The mechanism for the refill elevator 40 depicted in FIGS. 7*a* and 7*b* can equally be applied to the elevator 40 depicted in FIGS. 1*a* and 1*b*, wherein only the elevator 40 together with the spindle 32 and the second coupling 31 are removed in that case.

The refill spindle 32 depicted in FIG. 7*b* further comprises a spindle base 37 in the form of a flange-like widening at its lower end which has a notch on its upper side (identifiable as a vertical surface in cross section). A corresponding projection is provided on the underside of the refill elevator 40 (not depicted) which can latch into the notch when the refill elevator 40 is situated at the lower end of the refill spindle 32. A specific rotational position of the first coupling 21 relative to the refill container 10' and the container 10 is thereby ensured In this position of the refill elevator 40.

FIGS. 8*a-c* again show an overview of the procedure for removing the elevator 40 from the container 10 of a deodorant dispenser (without inserted refill pack).

FIG. 8*a* shows an oblique view from above of a deodorant dispenser with an elevator 40 partially emerging from the container 10. After the elevator 40 reaches the upper end of the spindle 32, a further rotation of the rotary body 20 results in rotating the elevator 40. After rotation about a specific angle, here approximately 60 degrees, the elevator blocking region 44 abuts against the inner wall of the container, whereby further rotation is blocked (FIG. 8*b*). A further rotation of the rotary body 20 in the ascending direction disengages the connection of the first coupling 21 to the second coupling 31 since the elevator 40 and thus the spindle 32 cannot rotate any further in that direction. FIG. 8*c* shows the spindle 32 and the elevator 40 in the container 10 after the connection of the first coupling 21 to the second coupling 31 has been disengaged. By the user grasping the elevator 40, it can be removed together with the spindle 32 and the second coupling 31. The deodorant dispenser can thereafter, as an example, be refilled with a refill pack.

FIG. 8*d* again shows an oblique view from below of the elevator 40 with the elevator blocking regions 44, 44'.

LIST OF REFERENCE NUMERALS

10 container
10' refill container
11 closure
12 first sealing element
13 second sealing element
14 removal flange
20 rotary body
21 first coupling
22 coupling opening
23, 23' plug
25 first latching element
26 first separator element
32 spindle, refill spindle
33 spindle external thread
34 blocking region
35 second latching element
36 second separator element
37 spindle base
40 elevator, refill elevator
42 elevator opening
43 elevator internal thread
44, 44' elevator blocking region
50 deodorant mass
51 deodorant cover cap

The invention claimed is:

1. A deodorant dispenser comprising:

a container having a wall enclosing an interior space of the container; and a rotary body rotatably connected to the container and comprising a first coupling for a rotationally conjoint and form-fit separable connection in the interior space of the container to a second coupling, wherein the first coupling comprises:

at least one first latching element for latching with at least one second latching element of the second coupling and thus producing the rotationally conjoint and form-fit separable connection of the first coupling to the second coupling; and at least one first separator element for interacting with at least one second separator element of the second coupling and thus uncoupling the at least one first latching element and the at least one second latching element and disconnecting the rotationally conjoint and form-fit separable connection of the first coupling to the second coupling, wherein at least one continuous closable opening is formed in the deodorant dispenser from a lower exterior side of the deodorant dispenser to an upper end of the interior space of the container.

2. The deodorant dispenser according to claim 1, wherein the container has at least one first sealing element which seals an area between the container and the rotary body.

3. The deodorant dispenser according to claim 1, further comprising:

a spindle having the second coupling connected in the rotationally conjoint and form-fit manner to the first coupling, wherein the spindle has an external thread and wherein the spindle is arranged within the container and substantially parallel to its-a longitudinal axis of the container; and an elevator which extends inside the container substantially in at least a direction orthogonal to the spindle and is not rotatable relative to the wall of the container and has an internal thread in which the external thread of the spindle runs, wherein the at least one continuous closable opening in the deodorant dispenser extends from the lower exterior side of the deodorant dispenser through the elevator or past the elevator to the upper end of the interior space of the container, and wherein the container, the rotary body, the spindle, and the elevator are connected together such that:

rotating the rotary body results in a joint rotation of the first coupling and the second coupling and thus also the spindle in an ascending direction or a descending direction, via which the elevator is moved upward or downward respectively, and when the elevator is in an end position at an upper end of the spindle, rotating the rotary body results in the disconnecting of the rotationally conjoint and form-fit separable connection of the first coupling to the second coupling.

4. The deodorant dispenser according to claim 3, wherein the spindle has a first latching means and the elevator has a second latching means, wherein the elevator is configured such that rotating the rotary body in the descending direction, until the elevator is situated in an end position at a lower end of the spindle, results in the first latching means latching with the second latching means.

5. The deodorant dispenser according to claim 3, wherein the spindle exhibits a blocking region at the upper end of the spindle, and wherein the elevator is blockable in the end position at the upper end of the spindle.

6. The deodorant dispenser according to claim 3, wherein the second coupling comprises:

the at least one second latching element latched to the at least one first latching element of the first coupling so that the first coupling is connected to the second coupling in the rotationally conjoint and form-fit manner; and the at least one second separator element for interacting with the at least one first separator element of the first coupling and, when the elevator is situated in the end position at the upper end of the spindle, for uncoupling the at least one first latching element and the at least one second latching element and for disconnecting the rotationally conjoint and form-fit separable connection of the first coupling to the second coupling.

7. The deodorant dispenser according to claim 6, wherein the at least one first separator element and the at least one second separator element together form a wedge mechanism.

8. The deodorant dispenser according to claim 7, wherein the at least one first separator element and the at least one second separator element each exhibit at least six inclined surfaces.

9. The deodorant dispenser according to claim 6, wherein the at least one first separator element and the at least one second separator element together form a bayonet catch.

10. The deodorant dispenser according to claim 3, the elevator and the spindle are configured such that the elevator at least partially emerges from the container after reaching the upper end of the container and a further rotation of the spindle results in rotation of the elevator relative to the container.

11. The deodorant dispenser according to claim 10, wherein the elevator, when having at least partially emerged from the container, is configured such that after the elevator is further rotated about a specific angle relative to the container, the elevator is blocked relative to the container.

12. The deodorant dispenser according to claim 1, which further comprises a deodorant mass which at least partially fills the interior space of the container.

13. A refill pack for a deodorant dispenser, the refill pack comprising:

a refill container having a wall enclosing an interior space of the refill container;

a refill spindle with a second coupling which is connectable to a first coupling of a rotary body of the deodorant dispenser in a rotationally conjoint and form-fit manner, wherein the refill spindle has an external thread and wherein the refill spindle is arranged within the refill container and substantially parallel to a longitudinal axis of the refill container; and a refill elevator which extends inside the refill container substantially in at least a direction orthogonal to the refill spindle and is not rotatable relative to the wall of the refill container and which exhibits an internal thread in which the external thread of the refill spindle runs, wherein at least one continuous closable opening is formed in the refill pack from a lower exterior side of the refill pack to an upper end of the interior space of the refill container, wherein the refill container is insertable into a container of the deodorant dispenser by a rectilinear motion such that the first coupling of the rotary body of the deodorant dispenser is connected to the second coupling of the refill spindle in the rotationally conjoint and form-fit manner, and wherein the container of the deodorant dispenser, the refill container, the rotary body, the refill spindle, and the refill elevator are then connected together such that:

rotating the rotary body results in a joint rotation of the first coupling of the rotary body of the deodorant dispenser and the second coupling of the refill spindle and thus also of the refill spindle in an ascending direction or in a descending direction, via which the refill elevator is moved upward or downward respectively, and when the refill elevator is in an end position at an upper end of the refill spindle, rotating the rotary body results in a disconnecting of the connection of the first coupling of the rotary body of the deodorant dispenser to the second coupling of the refill spindle.

14. The refill pack according to claim 13, wherein the second coupling has at least one second sealing element which seals a region between the second coupling and the refill container.

15. The refill pack according to claim 13, wherein the second coupling is designed such that the first coupling of the rotary body of the deodorant dispenser is connectable to the second coupling in the rotationally conjoint and form-fit manner in any rotational position of the second coupling.

16. The refill pack according to claim 13, wherein the refill spindle has a first latching means and the refill elevator has a second latching means, wherein the refill elevator is configured such that rotating the rotary body of the deodorant dispenser in the descending direction, until the refill elevator is in an end position at a lower end of the refill spindle, results in the first latching means latching with the second latching means.

17. The refill pack according to claim 13, wherein the refill spindle exhibits a blocking region at the upper end of the refill spindle, and wherein the refill elevator is blockable in the end position at the upper end of the refill spindle.

18. The refill pack according to claim 13, wherein the second coupling comprises:

at least one second latching element able to be latched to at least one first latching element of the first coupling of the rotary body of the deodorant dispenser so that the first coupling is connected to the second coupling in the rotationally conjoint and form-fit manner; and at least one second separator element for interacting with at least one first separator element of the first coupling of the deodorant dispenser and, when the refill elevator is situated in the end position at the upper end of the refill spindle, for disengaging the at least one first latching element and the at least one second latching element and for disconnecting the rotationally conjoint and form-fit separable connection of the first coupling to the second coupling.

19. The refill pack according to claim 18, wherein the at least one second separator element is designed to form a wedge mechanism together with the at least one first separator element of the first coupling of the deodorant dispenser.

20. The refill pack according to claim 19, wherein the at least one second separator element exhibits at least six inclined surfaces.

21. The refill pack according to claim 18, wherein the at least one second separator element is designed to form a bayonet catch together with the at least one first separator element of the first coupling of the deodorant dispenser.

22. The refill pack according to claim 13, wherein the refill elevator and the refill spindle are configured such that the refill elevator at least partially emerges from the refill container after reaching the upper end of the refill container and a further rotation of the refill spindle results in a rotation of the refill elevator relative to the refill container.

23. The refill pack according to claim 22, wherein the refill elevator, when having at least partially emerged from the refill container, is configured such that after the refill elevator is further rotated about a specific angle relative to the refill container, the refill elevator is blocked relative to the refill container.

24. The refill pack according to claim 13, which further comprises a deodorant mass which at least partially fills the interior space of the refill container.

25. A deodorant dispenser system comprising:

a deodorant dispenser comprising:

a container having a wall enclosing an interior space of the container; and a rotary body rotatably connected to the container and comprising a first coupling for a rotationally conjoint and form-fit separable connection in the interior space of the container to a second coupling, wherein at least one continuous closable opening is formed in the deodorant dispenser from a lower exterior side of the deodorant dispenser to an upper end of the interior space of the container;

a refill pack comprising:

a refill container having a wall enclosing an interior space of the refill container;

a refill spindle with the second coupling which is connectable to the first coupling of the rotary body of the deodorant dispenser in the rotationally conjoint and form-fit manner, wherein the refill spindle has an external thread and wherein the refill spindle is arranged within the refill container and substantially parallel to a longitudinal axis of the refill container; and a refill elevator which extends inside the refill container substantially in at least a direction orthogonal to the refill spindle and is not rotatable relative to the wall of the refill container and which exhibits an internal thread in which the external thread of the refill spindle runs, wherein at least one continuous closable opening is formed in the refill pack from a lower exterior side of the refill pack to an upper end of the interior space of the refill container, wherein the refill container is insertable into the container of the deodorant dispenser by a rectilinear motion such that the first coupling of the rotary body of the deodorant dispenser is connected to the second coupling of the refill spindle in the rotationally conjoint and form-fit manner, and wherein the container of the deodorant dispenser, the refill container, the rotary body, the refill spindle and the refill elevator are then connected together such that:

rotating the rotary body results in a joint rotation of the first coupling of the rotary body of the deodorant dispenser and the second coupling of the refill spindle and thus also of the refill spindle in an ascending direction or in a descending direction, via which the refill elevator is moved upward or downward respectively, and when the refill elevator is in an end position at an upper end of the refill spindle, rotating the rotary body results in the disconnecting of the connection of the first coupling of the rotary body of the deodorant dispenser to the second coupling of the refill spindle; and a deodorant mass which at least partially fills the interior space of the refill container.

26. The deodorant dispenser system according to claim 25, wherein the deodorant dispenser further comprises:

a spindle having a third coupling connected in a rotationally conjoint and form-fit manner to the first coupling, wherein the spindle has an external thread and wherein the spindle is arranged within the container and substantially parallel to a longitudinal axis of the container; and an elevator which extends inside the container substantially in at least a direction orthogonal to the spindle and is not rotatable relative to the wall of the container and has an internal thread in which the external thread of the spindle runs, wherein the at least one continuous opening in the deodorant dispenser extends from the lower exterior side of the deodorant dispenser through the elevator or past the elevator to the upper end of the interior space of the container, and wherein the container, the rotary body, the spindle and the elevator are connected together such that:

rotating the rotary body results in a joint rotation of the first and third coupling and thus also the spindle in an ascending direction or a descending direction, via which the elevator is moved upward or downward respectively, and when the elevator is in an end position at an upper end of the spindle, rotating the rotary body results in the disconnecting of the connection of the first coupling to the third coupling, and wherein the spindle of the deodorant dispenser and the refill spindle of the at least one-refill pack are structurally identical and/or the elevator of the deodorant dispenser and the refill elevator of the refill pack are structurally identical or are structurally identical save for slightly differing external dimensions.

27. A method for filling a deodorant mass into a deodorant dispenser according to claim 3, the method comprising:

bringing the deodorant dispenser into a position in which the lower exterior side of the deodorant dispenser faces upwards;

liquefying the deodorant mass;

filling the deodorant mass into the container of the deodorant dispenser through the lower exterior side of the deodorant dispenser into the at least one continuous closable opening in the deodorant dispenser;

closing the at least one continuous closable opening in the deodorant dispenser; and solidifying the deodorant mass.

28. A method for filling a deodorant mass into a refill pack according to claim 13, the method comprising:

bringing the refill pack into a position in which the lower exterior side of the refill pack faces upward;

liquefying the deodorant mass;

filling the deodorant mass into the refill container of the refill pack through the lower exterior side of the refill pack into the at least one continuous closable opening in the refill pack;

closing the at least one continuous closable opening in the refill pack; and solidifying the deodorant mass.

29. A method for refilling a deodorant dispenser system according to claim 25, the method comprising:

inserting the refill container into the container of the deodorant dispenser by a rectilinear movement until the first coupling of the rotary body of the deodorant dispenser is connected to the second coupling of the refill spindle of the refill pack in the rotationally conjoint and form-fit manner.

30. A method for refilling a deodorant dispenser system according to claim 26, the method comprising:

rotating the rotary body of the deodorant dispenser in the ascending direction until the elevator is in the end position at the upper end of the spindle, rotating the rotary body of the deodorant dispenser and thereby disengaging the connection of the first coupling of the rotary body to the third coupling of the spindle;

removing the spindle with the third coupling and the elevator from the container; and inserting the refill pack into the container of the deodorant dispenser by a rectilinear movement until the first coupling of the rotary body of the deodorant dispenser is connected to the second coupling of the refill spindle of the refill pack in the rotationally conjoint and form-fit manner.

* * * * *